United States Patent [19]

Phillips, Sr.

[11] Patent Number: 4,820,208

[45] Date of Patent: Apr. 11, 1989

[54] DIRECTIONAL CONTROL MECHANISM FOR A TROLLING MOTOR

[76] Inventor: Walter A. Phillips, Sr., 9000 N. Nettle School Rd., Morris, Ill. 60450

[21] Appl. No.: 155,582

[22] Filed: Feb. 12, 1988

[51] Int. Cl.[4] ..... B63H 21/26

[52] U.S. Cl. ..... 440/7; 440/62

[58] Field of Search ..... 440/6, 7, 62; 74/480 B

[56] References Cited

U.S. PATENT DOCUMENTS

| | | | |
|---|---|---|---|
| 2,877,733 | 3/1959 | Harris | 440/7 |
| 3,561,393 | 2/1971 | Fortson | 440/7 |
| 3,598,947 | 8/1971 | Osborn | 440/7 |
| 3,602,181 | 8/1971 | Harris | 440/7 |
| 3,606,858 | 9/1971 | Edwards et al. | 440/7 |
| 3,889,625 | 6/1975 | Roller et al. | 440/7 |
| 3,989,000 | 11/1976 | Foley, Jr. | 440/6 |
| 4,143,436 | 3/1979 | Jones | 440/7 |

*Primary Examiner*—Sherman D. Basinger

*Attorney, Agent, or Firm*—Jerry T. Kearns

[57] ABSTRACT

A directional control mechanism for an electric trolling motor utilizes a plurality of foot pedal actuated switches to control a reversible directional control motor. A gear reduction unit connected to the directional control motor has an output shaft which rotates a drive pulley. A second pulley, connected to a rotatable trolling motor mounting shaft, is driven by a belt in engagement with the drive pulley. An electrical slip ring contact on the second pulley transmits current to the electric trolling motor. The trolling motor is also controlled by a switch activated by the foot pedal.

5 Claims, 6 Drawing Sheets

DIRECTIONAL CONTROL MECHANISM FOR A TROLLING MOTOR

BACKGROUND OF THE INVENTION

1. Field of the Invention

The present invention relates to directional control mechanisms, and more particularly pertains to a new and improved foot pedal actuated directional control mechanism for electric trolling motors. Electric trolling motors for fishing boats are typically mounted on an elongated shaft. An inner shaft, rotatably mounted within the outer shaft, allows the motor to be rotated about the axis of the inner shaft, thus allowing directional control of the boat. Most available electric trolling motors provide a manually actuated handle for rotating the inner shaft. This manual actuation forces an individual to use at least one hand to control the trolling motor direction. In order to leave an individual's hands free for fishing and other activities, the present invention provides an improved directional control mechanism which utilizes a foot pedal actuated electric motor in conjunction with a belt and pulley drive to rotate the inner trolling motor mounting shaft.

2. Description of the Prior Art

Various types of directional control mechanisms for trolling motors are known in the prior art. A typical example of such a directional control mechanism is to be found in U.S. Pat. No. 3,561,393, which issued to W. Fortson on Feb. 9, 1971. This patent discloses a manually actuated control linkage for controlling the direction of an electric trolling motor. A pivotal knee yoke is connected by a linkage such that, by swinging the knee yoke from side to side, an individual may exercise manual directional control of the trolling motor. U.S. Pat. No. 3,598,947, which issued to R. Osborn on Aug. 10, 1971, discloses a foot pedal actuated directional control mechanism for an electric trolling motor. A plurality of switches arranged to be actuated by rocking of a foot pedal control an electric directional control motor. The directional control motor is connected to rotate the trolling motor mounting shaft by a direct gear drive. U.S. Pat. No. 3,602,181, which issued to G. Harris on Aug. 31, 1971, discloses a directional control mechanism for an electric motor which utilizes a foot pedal to actuate a rack and pinion drive to rotate a trolling motor mounting shaft. The rack is reciprocated by a mechanical cable linkage operated by a pivotal foot pedal. U.S. Pat. No. 3,606,358, which issued to N. Edwards et al on Sept. 21, 1971, discloses a directional control mechanism for an electric trolling motor which utilizes a foot pedal actuated mechanical linkage to rotate a trolling motor mounting shaft. A mechanically actuated chain and sprocket drive is utilized to rotate the trolling motor mounting shaft. U.S. Pat. No. 3,889,625, which issued to W. Roller et al on June 17, 1975, discloses a directional control mechanism for an electric trolling motor which utilizes a foot pedal actuated mechanical cable linkage to rotate a trolling motor mounting shaft. U.S. Pat. No. 4,143,436, which issued to R. Jones on Mar. 13, 1979, discloses a directional control mechanism for a trolling motor which utilizes a chair mounted pivotal foot pedal to extend and retract a mechanical cable linkage to rotate a trolling motor mounting shaft. A sliding brush assembly provides continuous electrical connection between rotating conductor wires and stationary conducting wires for supplying electrical current to the trolling motor.

While the above mentioned devices are suited for their intended usage, none of these devices provide a directional control mechanism for an electric trolling motor which utilizes a reversible motor in conjunction with a gear reduction unit and a belt and pulley drive to selectively rotate a mounting shaft of an electric trolling motor. Additionally, none of the aforesaid devices provide a trolling motor mounting shaft with a belt driven pulley having electrical slip ring contacts for conducting electrical current to an electric trolling motor. Inasmuch as the art is relatively crowded with respect to these various types of directional control mechanisms, it can be appreciated that there is a continuing need for and interest in improvements to such directional control mechanisms, and in this respect, the present invention addresses this need and interest.

SUMMARY OF THE INVENTION

In view of the foregoing disadvantages inherent in the known types of directional control mechanisms now present in the prior art, the present invention provides an improved directional control mechanism for a trolling motor. As such, the general purpose of the present invention, which will be described subsequently in greater detail, is to provide a new and improved directional control mechanism for a trolling motor which has all the advantages of the prior art directional control mechanisms and none of the disadvantages.

To attain this, a representative embodiment of the concepts of the present invention is illustrated in the drawings and makes use of a plurality of foot pedal actuated switches to control a reversible directional control motor. A gear reduction unit connected to the directional control motor has an output shaft which rotates a drive pulley. A second pulley, connected to a rotatable trolling motor mounting shaft, is driven by a belt in engagement with the drive pulley. An electrical slip ring contact on the second pulley transmits current to the electric trolling motor. The trolling motor is also controlled by a switch activated by the foot pedal.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved directional control mechanism for a trolling motor which has all the advantages of the prior art directional control mechanisms and none of the disadvantages.

It is another object of the present invention to provide a new and improved directional control mechanism for a trolling motor which may be easily and efficiently manufactured and marketed.

It is a further object of the present invention to provide a new and improved directional control mechanism for a trolling motor which is of a durable and reliable construction.

An even further object of the present invention is to provide a new and improved directional control mechanism for a trolling motor which is susceptible of a low cost of manufacture with regard to both materials and labor, and which accordingly is then susceptible of low prices of sale to the consuming public, thereby making such directional control mechanisms economically available to the buying public.

Still yet another object of the present invention is to provide a new and improved directional control mechanism for a trolling motor which provides in the apparatuses and methods of the prior art some of the advantages thereof, while simultaneously overcoming some of the disadvantages normally associated therewith.

Still another object of the present invention is to provide a new and improved directional control mechanism for a trolling motor which utilizes a foot pedal controlled reversible motor in conjunction with a belt and pulley drive for selectively rotatably positioning a trolling motor mounting shaft.

Yet another object of the present invention is to provide a new and improved directional control mechanism for a trolling motor which provides an improved foot pedal control design to allow precise directional control.

Even still another object of the present invention is to provide a new and improved directional control mechanism for a trolling motor which utilizes a belt driven pulley provided with slip ring electrical contacts and mounted on a trolling motor mounting shaft to transmit electrical current to a trolling motor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
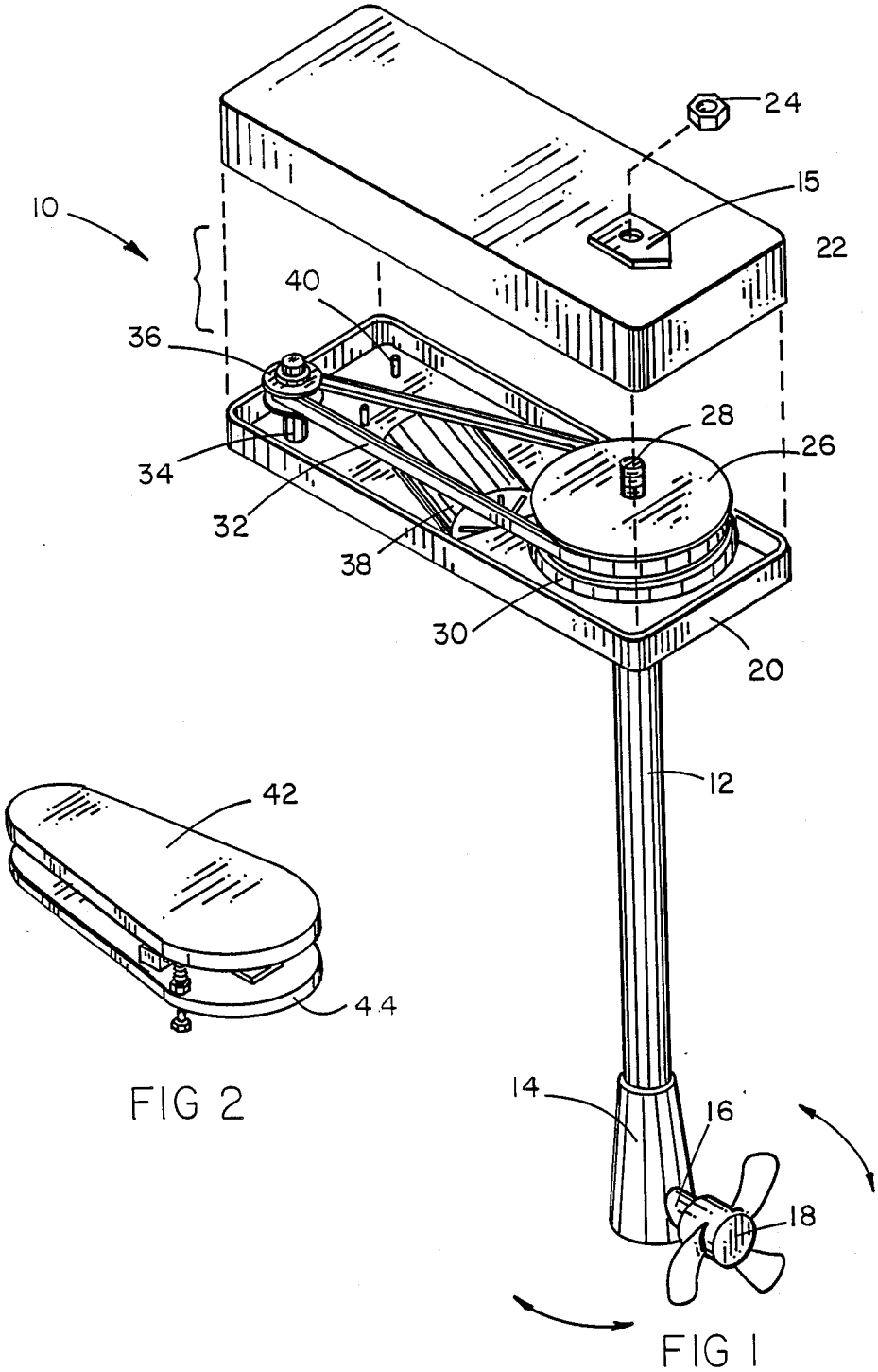
FIG. 1 is a perspective view of the trolling motor directional control mechanism of the present invention.
FIG. 2 is a perspective view of the foot pedal control of the present invention.

With reference now to the drawings, and in particular to FIG. 1 thereof, a new and improved directional control mechanism for a trolling motor embodying the principles and concepts of the present invention and generally designated by the reference numeral 10 will be described.

More specifically, it will be noted that the first embodiment 10 of the invention includes a stationary outer hollow shaft 12 on which a motor mount 14 is rotatably attached. A conventional electric trolling motor 16 is secured to the motor mount 14. A propeller 18, attached to a rotary output shaft of the motor 16, provides a propulsion force to a boat on which the motor 16 is attached. The stationary outer shaft 12 may be secured by a variety of conventional transom clamps (not shown) to the stern of a boat. The details of the motor 16, motor mount 14, and transom clamp form no part of the present invention, and thus are not further described herein. A generally rectangular mounting plate 20 is transversely connected adjacent an upper end of the shaft 12. A generally rectangular housing cover 22 is frictionally secured to the mounting plate 20. Within the housing cover 22, a pulley 26 is secured to an inner trolling motor pivot shaft. The pulley 26 is arranged to be driven by a belt 32 in conjunction with a drive pulley 36 secured to an output shaft 34 of a gear reduction unit connected to a reversible directional control motor 38. Thus, by actuating the motor 38, the pulley 26 will be rotated in the selected direction, rotating the motor mount 14 about the axis of the shaft 12, thus providing directional control. A plurality of slots 40 in the bottom of the mounting plate 20 allow adjustable positioning of the motor 38 and attached gear reduction unit to adjust the tension of the belt 32. A directional indicator 15 is secured for rotation with the stud 28 by the lock knot 24. Thus, the pointer 15 provides a visual indication of the rotational position of the motor mount 14. The stud 28 rotates freely within the aperture in the housing cover 22.

In FIG. 2, a perspective view is provided which illustrates a foot control pedal for actuating the directional control motor 38 and electric trolling motor 16. A top plate 42 is pivotally connected to a bottom plate 44 for side to side and front to back rocking movement.

Figure 3:
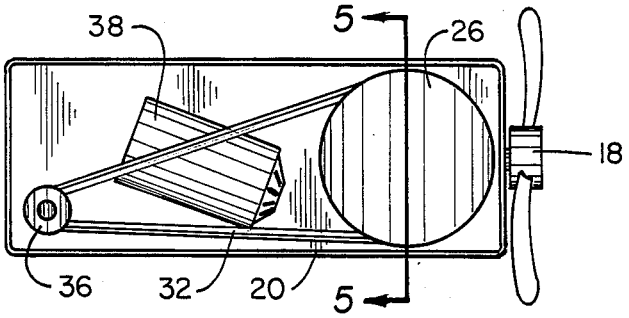
FIG. 3 is a top view of the directional control mechanism of FIG. 1, with the housing cover removed.

In FIG. 3, a top view of the directional control mechanism of the present invention is provided.

Figure 4:
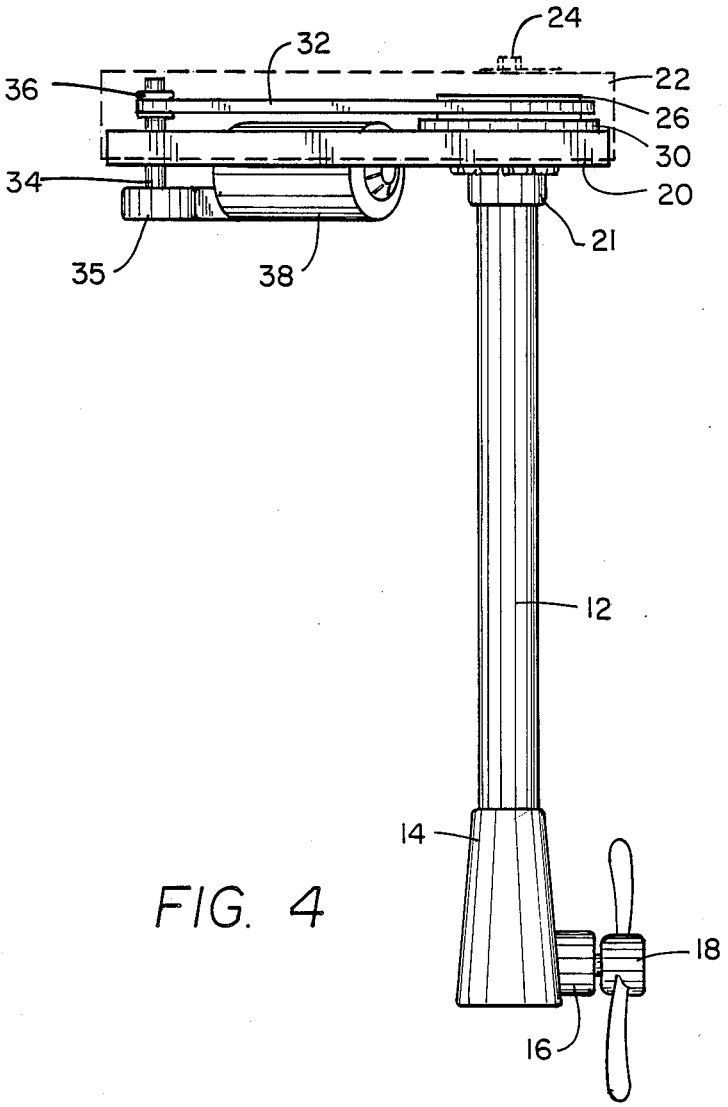
FIG. 4 is a side view of the directional control mechanism of FIG. 1.

With reference now to FIG. 4, it may be seen that a conventional worm type gear reduction unit 35 is connected to the directional control motor 38. The rotary output shaft 34 of the gear reduction unit 35 extends upwardly through the mounting plate 20 and is secured to a drive pulley 36. The belt 32 is connected to rotate pulley 26. The pulley 26 is positioned coaxially with a stationary contact disc 30. A threaded collar 21 secures the mounting plate 20 to the stationary outer hollow shaft 12.

Figure 5:
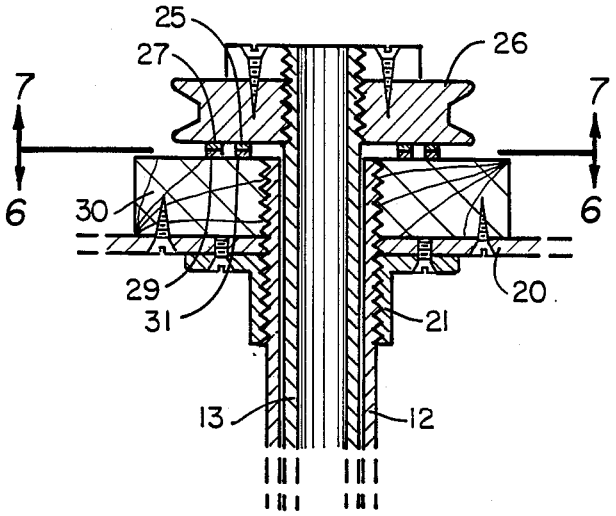
FIG. 5 is a partial longitudinal cross sectional view of the trolling motor mounting shaft and drive pulley arrangement, taken along line 5—5 of FIG. 3.

As shown in FIG. 5, an inner rotatable trolling motor mounting shaft 13 is received coaxially within the hollow outer shaft 12. The inner shaft 13 is also hollow for the reception of electrical leads (not shown) which transmit power through the interior of the inner shaft 13 to the trolling motor 16. As shown, the pulley 26 is secured for rotation with the inner shaft 13, while the stationary contact disc 30 is secured to the outer shaft 12 and the mounting plate 20. A pair of positive terminal spring bias copper brushes 27 and a pair of negative terminal spring bias copper brushes 25 are secured to a lower face of the pulley 26. These brushes 25 and 27 are in contact with inner 31 and outer 29 brush contact rings secured to the upper face of the contact disc 30. Conventional electrical wiring (not shown) connects the brushes 25 and 27 on the pulley 26 to the trolling motor 16. This wiring extends through the interior of the inner shaft 13. Thus, the brushes 25, 27 and the contact rings 29, 31 form a rotatable electrical connection for transmitting electrical current to the trolling motor 16.

Figure 6:
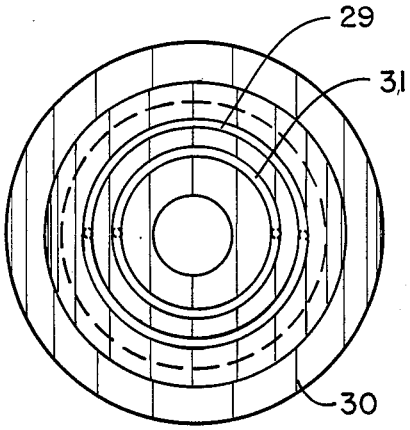
FIG. 6 is a cross sectional view, taken along line 6—6 of FIG. 5, illustrating the stationary contact ring disc.

In FIG. 6, a cross sectional view taken along line 6—6 of FIG. 5 illustrates the upper face of the stationary contact disc 30.

Figure 7:
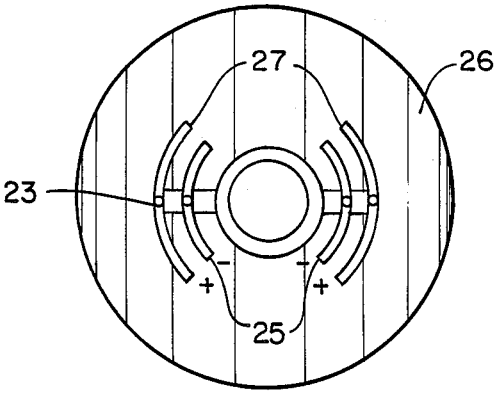
FIG. 7 is a cross sectional view, taken along line 7—7 of FIG. 5, illustrating the rotatable pulley brush assembly.

In FIG. 7, a cross sectional view taken along 7—7 of FIG. 5 illustrates the lower face of the pulley 26.

Figure 8:
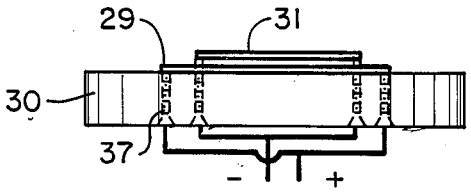
FIG. 8 is a side view of the stationary contact disc of FIG. 6.

In FIG. 8, a side view illustrates the contact rings 29 and 31 on the stationary contact disc 30. The contact rings 29 and 31 are secured by a plurality of screws 37 to the contact disc 30. These contact rings 29 and 31 are connected to a conventional electric battery.

Figure 9:
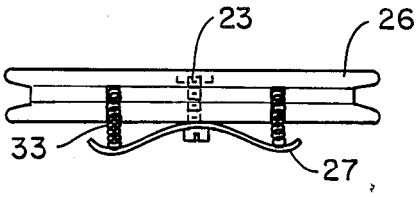
FIG. 9 is a side view of the pulley of FIG. 7.

In FIG. 9, a side view of the pulley 26, illustrates the arcuate configuration of the brush 27 and the brush springs 33. Each of the brushes 25 and 27 is secured by a conventional threaded fastener 23 to the pulley 26.

Figure 10:
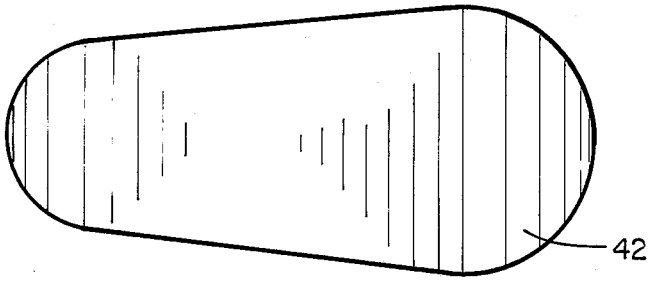
FIG. 10 is a top view of the foot pedal control of FIG. 2.

The top view of FIG. 10 illustrates the oval shape of the foot pedal upper plate 42. This shape is designed to cooperate with a foot of an individual to provide precise directional control.

Figure 11:
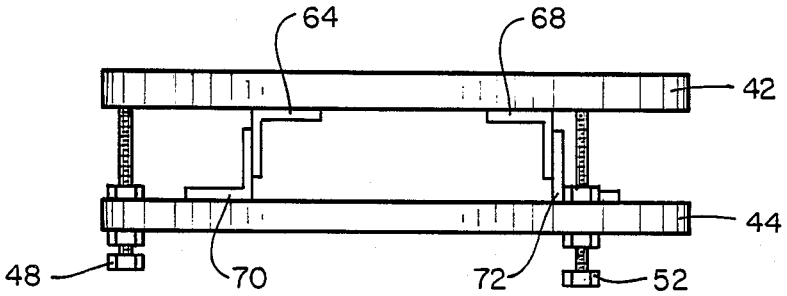
FIG. 11 is a side view of the foot pedal control.

In FIG. 11, it may be seen that a plurality of stop rods 48 and 52 are provided with adjustable lock nuts for regulating the position of the upper plate 42 with respect to the lower plate 44. A plurality of L-shaped brackets 64, 68, 70 and 72 are secured to the upper 42 and lower 44 plates.

Figure 12:
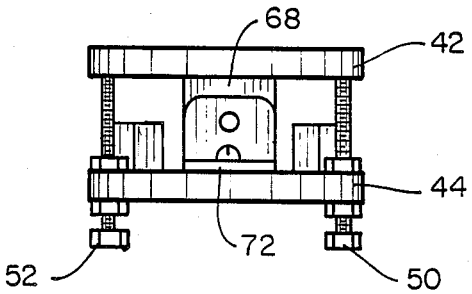
FIG. 12 is an front end view of the foot pedal control.

In FIG. 12, a front end view of the foot pedal assembly illustrates the adjustable stop rods 50 and 52 which are threadably engaged with the lower mounting plate 44 and have end portions in abutment with the upper plate 42.

Figure 13:
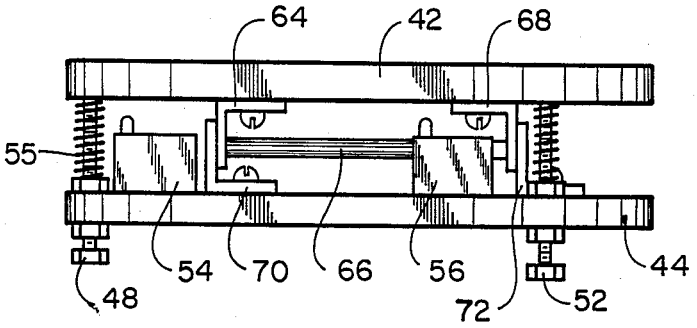
FIG. 13 is a side view of the foot pedal control, illustrating the control switch mounting.

In FIG. 13, a completely assembled side view of the foot pedal control is illustrated. A coil spring 55 is concentrically received around each of the adjustable stop rods. The springs 55 bias the upper plate 42 upwardly, away from the lower plate 44. A pivot rod 66 is rigidly secured within cylindrical apertures in the bottom L-shaped brackets 70 and 72 which are secured by conventional threaded fasteners on the lower plate 44. The pivot rod 66 is loosely received in slots formed in the upper pivot rod brackets 64 and 68 which are secured to the top plate 52. By virtue of this construction, the upper plate 42 may be rocked from front to back and from side to side with respect to the lower plate 44. A plurality of switches 54, 56 on the lower plate 44 are arranged to be actuated by selective rocking movement of the upper plate 42. The range of available movements of the upper plate 42 may be controlled by adjusting the stop rods 48, 52, to allow proper switch actuation, while preventing potential switch damage from over travel.

Figure 14:
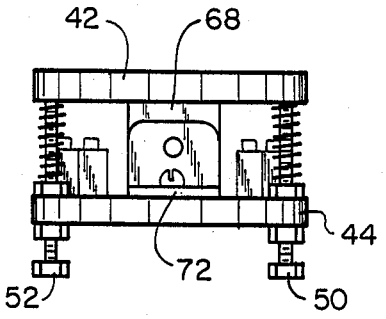
FIG. 14 is a front end view of the control pedal of FIG. 13.

In FIG. 14, a front end view of the completely assembled foot control pedal is provided.

Figure 15:
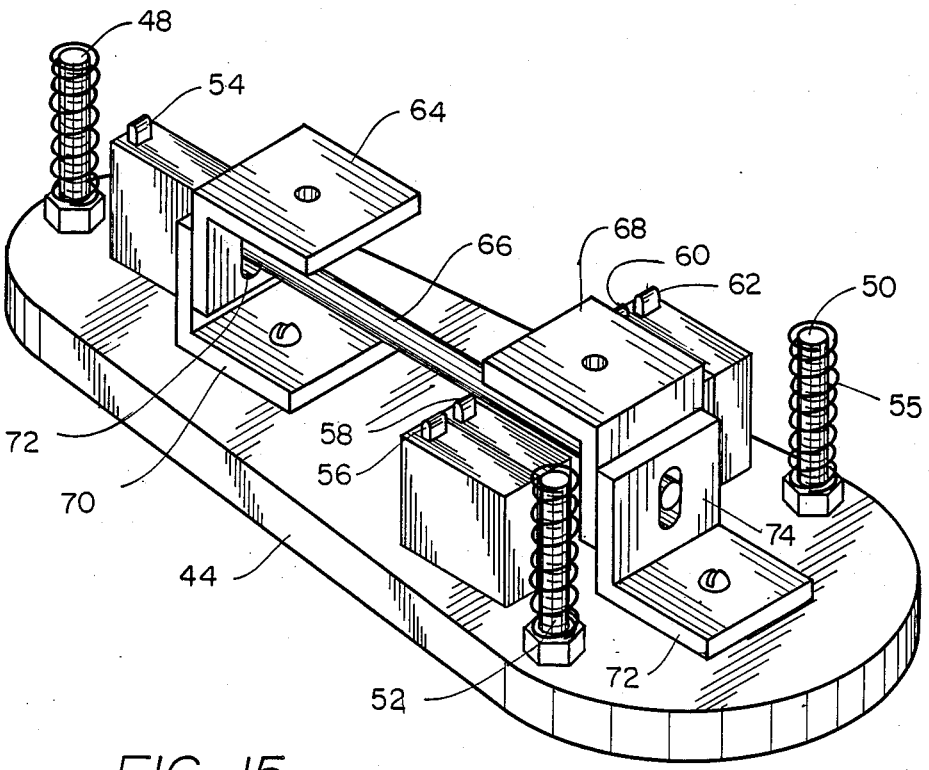
FIG. 15 is a perspective view of the foot pedal control, with the top plate removed.

In FIG. 15, a perspective view of the foot pedal control assembly is provided, with the upper plate 42 removed. The threaded adjustable stop rods 48, 50 and 52 are positioned as illustrated, with the stop rod 48 positioned at a rear heel portion of the lower plate 44 and the stop rods 50 and 52 positioned at opposite sides adjacent a front portion of the plate 44. Five micro switches 54, 56, 58, 60 and 62 are positioned on the bottom plate 44, as illustrated. The micro switch 54 positioned adjacent the heel portion of the plate 44 is electrically connected to selectively actuate the trolling motor 16. The micro switches 56, 58, 60 and 62 are actuated by selective side to side rocking movement of the upper plate 42. When the upper plate 42 is rocked to the left side, the switches 60 and 62 will be actuated, thus energizing the direction control motor 38 for rotary output in a first direction. By positioning the upper plate 42 in a central elevated position, the directional control motor 38 will be deactivated. By rocking the plate 42 to the right, the micro switches 56 and 58 will be activated, thus causing the directional control motor 38 to rotate in an opposite direction, by reversing the polarity of the power supply thereto.

Figure 16:
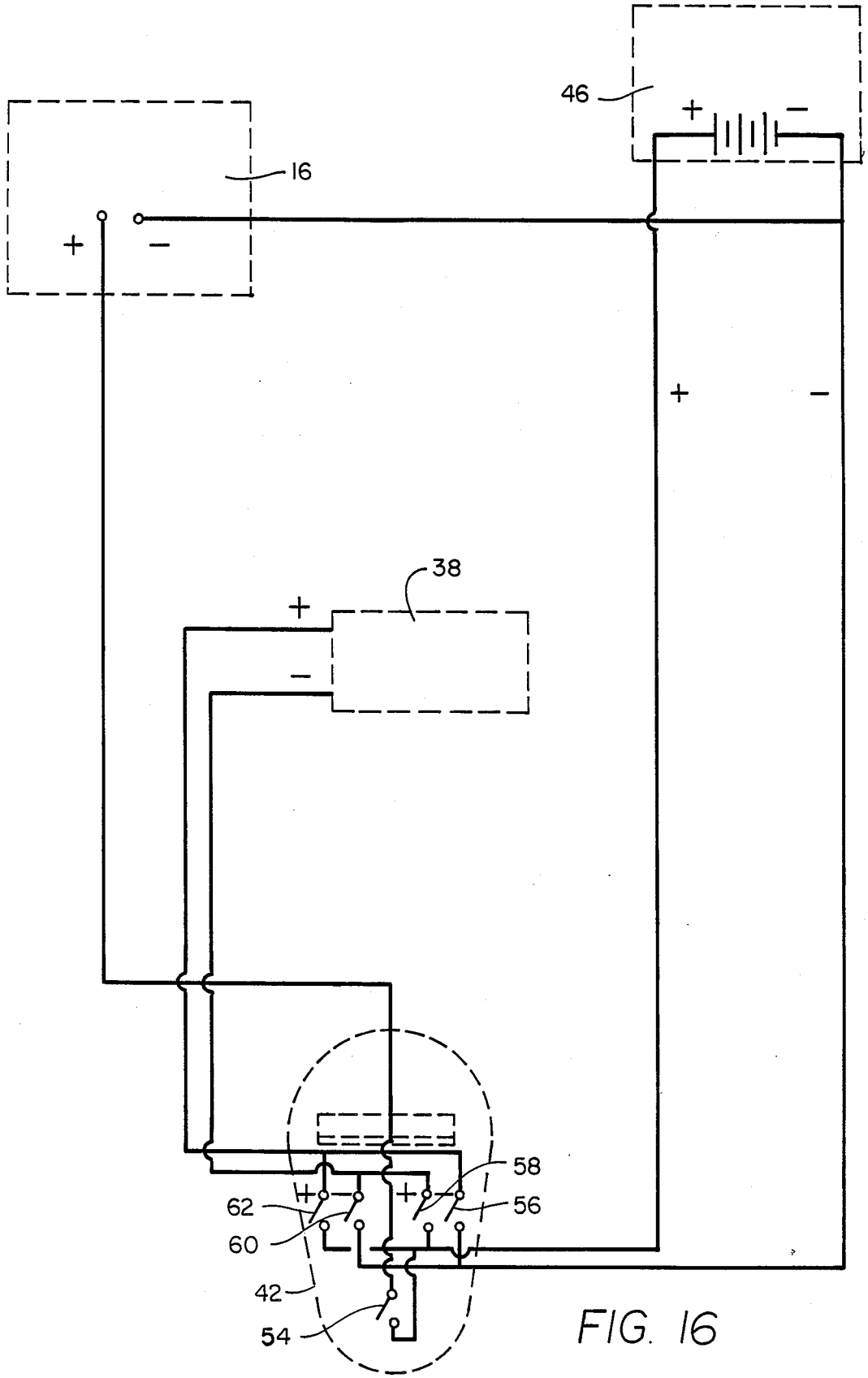
FIG. 16 is a schematic diagram, illustrating the electrical connections of the various components of the directional control mechanism of the present invention.

In FIG. 16, a schematic diagram illustrates the electrical connections of the various components. The switch 54 is connected for selective actuation of the trolling motor 16 by a conventional storage battery 46. By simultaneously closing switches 56 and 58, the directional control motor 38 will be caused to rotate in a first direction. By subsequently opening the switches 56 and 58 and closing the switches 60 and 62, the polarity of the power supply to the directional control motor 38 will be reversed, thus causing the directional control motor 38 to rotate in an opposite direction. As may now be understood, the directional trolling motor control mechanism of the present invention allows a trolling motor to be selectively actuated from a foot pedal control. Additionally, the foot pedal control allows a reversible directional control.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved directional control mechanism for a trolling motor, comprising:

an outer stationary hollow shaft;

a motor mount secured to said outer shaft for rotation around said outer shaft;

an electric trolling motor secured to said motor mount;

a hollow inner shaft coaxially received in said outer shaft, said inner shaft connected for rotating said motor mount;

mounting plate means on an upper end of said stationary shaft;

said inner shaft extending upwardly through said mounting plate means;

pulley means on said inner shaft;

belt and pulley drive means operatively connected to said pulley means;

directional control motor means on said mounting plate means;

gear reduction means on said mounting plate means operatively connected to said directional control motor means;

said gear reduction means having a rotary output shaft operatively connected to said belt and pulley drive means;

battery means operatively connected for powering said trolling motor and said directional control motor means;

foot pedal control means for reversing polarity of said directional control motor means; and rotary electrical contact means on said pulley means for transmitting electrical current to said trolling motor.

2. The directional control mechanism of claim 1, wherein said rotary electrical contact means comprises a stationary contact disc on an upper surface of said mounting plate means secured to said outer stationary shaft;

a plurality of concentric electrical contact rings on an upper surface of said stationary contact disc;

a plurality of spring biased electrical brushes on a lower surface of said pulley means, said brushes in rotary engagement with said contact ring.

3. The directional control mechanism of claim 1, wherein said foot pedal control means comprises a pair of pivotally connected overlying oval plates.

4. The directional control mechanism of claim 3, further comprising a pair of "L"-shaped brackets secured to facing surfaces of each of said oval plates;

a pivot rod extending through an aperture in each of said "L"-shaped brackets;

a plurality of threaded adjustable stop rods extending upwardly from said lower oval plate for engagement with said upper oval plate;

a coil spring around each of said stop rods biasing said upper oval plate away from said lower oval plate;

a first switch operatively connected for actuating said trolling motor mounted adjacent a rear heel portion of said lower oval plate; and two pairs of directional control motor control switches mounted adjacent a front portion of said lower oval plate, one pair of said directional control motor switches disposed on each side of said pivot rod.

5. A new and improved directional control mechanism for a trolling motor, comprising:

an outer stationary hollow shaft;

a motor mount secured to said outer shaft for rotation around said outer shaft;

an electric trolling motor secured to said motor mount;

a hollow inner shaft coaxially received in said outer shaft, said inner shaft connected for rotating said motor mount;

mounting plate means on an upper end of said stationary shaft;

said inner shaft extending upwardly through said mounting plate means;

pulley means on said inner shaft;

belt and pulley drive means operatively connected to said pulley means;

directional control motor means on said mounting plate gear reduction means on said mounting plate means operatively connected to said directional control motor means;

said gear reduction means having a rotary output shaft operatively connected to said belt and pulley drive means;

battery means operatively connected for powering said trolling motor and said directional control motor means;

foot pedal control means for reversing polarity of said directional control motor means;

rotary electrical contact means on said pulley means for transmitting electrical current to said trolling motor;

said rotary electrical contact means comprising a stationary contact disc on an upper surface of said mounting plate means secured to said outer stationary shaft;

a plurality of concentric electrical contact rings on an upper surface of said stationary contact disc;

a plurality of spring biased electrical brushes on a lower surface of said pulley means, said brushes in rotary engagement with said contact rings;

said foot pedal control means comprising a lower oval plate pivotally connected to an overlying upper oval plate;

a pair of "L"-shaped brackets secured to facing surfaces of each of said oval plates;

a pivot rod extending through an aperture in each of said "L"-shaped brackets;

a plurality of threaded adjustable stop rods extending upwardly from said lower oval plate for engagement with said upper oval plate;

a coil spring around each of said stop rods biasing said upper oval plate away from said lower oval plate;

a first switch operatively connected for actuating said trolling motor mounted adjacent a rear heel portion of said lower oval plate; and two pairs of directional control motor control switches mounted adjacent a front portion of said lower oval plate, one pair of said directional control motor switches disposed on each side of said pivot rod.

* * * * *